US007690863B2

(12) United States Patent
Fourches et al.

(10) Patent No.: US 7,690,863 B2
(45) Date of Patent: Apr. 6, 2010

(54) DEVICE FOR HOLDING A LEVELING STRIP ON A CARRIAGE FOR APPLYING COLD LAID COATINGS

(75) Inventors: Francis Fourches, Verneuil sur Seine (FR); Michel Pierre, Jauldes (FR)

(73) Assignee: Eurovia, Rueil Malmaison (FR)

( * ) Notice: Subject to any disclaimer, the term of this patent is extended or adjusted under 35 U.S.C. 154(b) by 0 days.

(21) Appl. No.: 12/274,131

(22) Filed: Nov. 19, 2008

(65) Prior Publication Data

US 2009/0142134 A1 Jun. 4, 2009

(30) Foreign Application Priority Data

Nov. 21, 2007 (FR) ..... 07 59191

(51) Int. Cl.
*E01C 19/12* (2006.01)

(52) U.S. Cl. ..... 404/101; 404/105; 404/108; 404/118; 401/48

(58) Field of Classification Search ..... 404/101, 404/105, 108, 118; 401/48
See application file for complete search history.

(56) References Cited

U.S. PATENT DOCUMENTS

| | | | | |
|---|---|---|---|---|
| 3,901,618 | A | 8/1975 | Sant'Agata | |
| 5,120,155 | A | 6/1992 | Samspon | |
| 5,362,178 | A * | 11/1994 | Schantz | 404/101 |
| 6,102,615 | A * | 8/2000 | Wilson, Sr. | 404/111 |

* cited by examiner

*Primary Examiner*—Raymond W Addie
(74) *Attorney, Agent, or Firm*—Foley & Lardner LLP

(57) ABSTRACT

The invention relates to a device for holding a levelling strip (14) on a carriage for applying cold laid coatings, wherein said strip extends in a direction that is generally perpendicular to the direction of movement of the carriage, characterised in that said carriage comprises on the rear side opposite to the direction of its movement a support frame (12) which has an adjustable length so that it can adapt to the width of the application zone of the coating and which supports a levelling strip (14), made from a flexible and slightly elastic material, of which one first free end (16) is attached to a first free external edge of the support frame (18) and in that the second free external edge (20), that is opposite the first, of the support frame comprises a vertical axis breast roller (22) on which the levelling strip (14) is tensioned by means of a winding device (24) that applies to said strip a suitable tension while permitting the continuous adjustment of the working length of said strip.

12 Claims, 2 Drawing Sheets

DEVICE FOR HOLDING A LEVELING STRIP ON A CARRIAGE FOR APPLYING COLD LAID COATINGS

This invention relates to a device for holding a levelling strip on a carriage for applying cold laid coatings.

Cold laid coatings, formed from a mixture of an emulsion of tarmac, cement and mineral aggregates, are especially used for road surfaces. The main function of such a levelling strip is to equalise the product applied to the highway in the best possible conditions, to avoid affecting its surface condition, while keeping in mind that the application width is often variable depending on the exact nature of the work. Therefore, it must be possible to adjust the length of the levelling strip easily.

At present, there are different solutions for fitting the levelling strip onto the carriages for applying cold laid coatings for work where the width of application is variable.

A first solution consists of the use of a rigid flap equipped on at one of its ends, with extensions which allow it to be adapted to the working width required. Such a solution is not satisfactory in practice due to the presence of crossovers of the flaps which causes the presence of striations on the free surface of the surface. Furthermore, different operations for fitting and removing the extensions of the rigid flap require considerable handling operations and wasted time.

A second solution lies in the use of several flaps of different lengths, selected in function of the width of the highway. In practice, strips whose length are adjustable by extension are used in a range of 2.50 m to 2.80 m or even 2.80 m to 3.20 m. This solution has the major disadvantage of requiring the use of elastic strips that are subjected to repeated traction forces for the different extension adjustments, which causes frequent breakages of the strip. The strong tension forces applied to these strips to extend them after a certain period of use create longitudinal undulations which generate poor levelling quality. Once again, this solution requires tiresome fitting and removal operations of the different strips and tensioning systems to reach the correct length.

Finally the idea of using a single levelling strip with a high coefficient of elongation was envisaged, which would allow by extension, to cover all of the widths of application encountered. In reality, this solution is unsatisfactory as, apart from the problems caused by delicate extension operations, very quickly such strips have longitudinal undulations due to excess tension on the strip, which lead to a poor levelling result on the surface of the cold laid coating.

The device that is the subject of this invention allows all of these disadvantages to be overcome. It is especially designed to improve and facilitate the application of levelling strips used on applicator carriages and to permit an improvement in the quality of the highway surfaces created using cold laid coatings.

More precisely, this invention relates to a device for holding a levelling strip on a carriage for applying cold laid coatings, wherein said strip extends in a direction that is generally perpendicular to the direction of movement of the carriage, characterised in that said carriage comprises on the rear side opposite to the direction of its movement a support frame which has an adjustable length so that it can adapt to the width of the application zone of the coating and which supports a levelling strip, made from a flexible and slightly elastic material, of which one first free end is attached to a first free external edge of the support frame, and in that the second free external edge, that is opposite the first, of the support frame comprises a vertical axis breast roller on which the levelling strip is tensioned by means of a winding device that applies to said strip a suitable tension while permitting the continuous adjustment of the working length of said strip.

Such a device eliminates the need to use strips with strong elasticity that consequently have low hardness. The device that is the subject of this invention allows in return the use of strips with a coefficient of elongation less than or equal to 400% and/or a hardness greater than or equal to 60 Shore. The levelling strips with such features have better abrasion resistance and therefore a much longer life compared to the usual elastic strips used at present. Furthermore, the mechanical features of these strips allows considerable improvement in the quality of the levelling of the cold laid coatings by especially avoiding the appearance on the highway of the longitudinal marks generally observed on the surface of the highway.

Other features and advantages of this invention will become clear upon reading the following detailed description, especially in reference to the appended drawings, in which identical elements are designated by the same numerical references.

Figure 1:
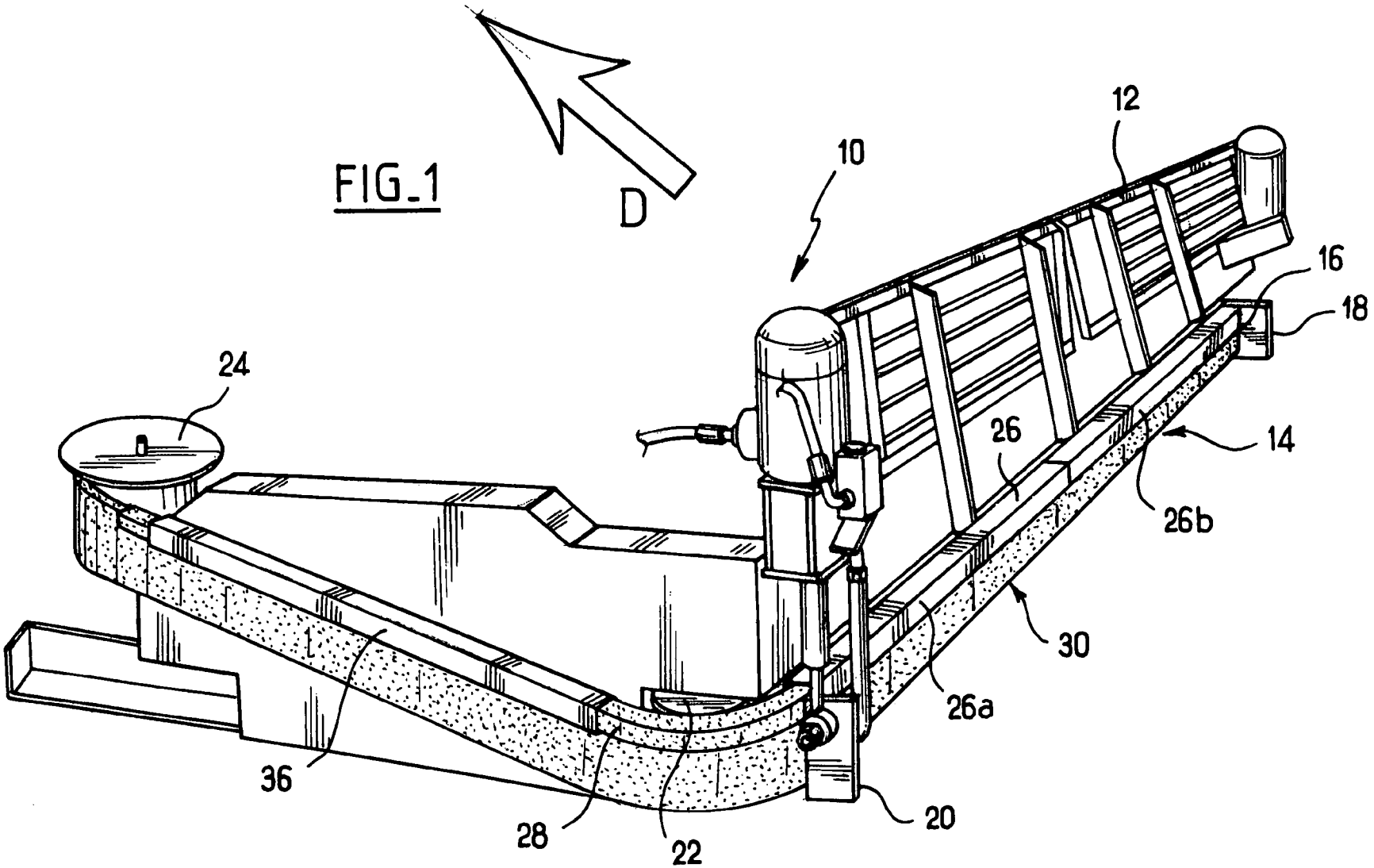
FIG. 1 shows a diagrammatical perspective view of a carriage for applying cold laid coatings, equipped with the holding device according to the invention.

Usually, the carriage 10 for applying cold laid coatings, comprises a support frame 12 on which the levelling strip 14 is fixed that extends according to a direction that is generally perpendicular to the direction of movement of the carriage illustrated by the arrow (D) in FIG. 1. Such an applicator carriage comprises, on the rear side that is opposite to its direction of movement (D), a support frame 12 whose length is adjustable so that it can adapt to the width of the application zone of the cold laid coating.

Consequently, the applicator carriage which carries the levelling strip 14 can adapt to suit the width of the work required. Within the scope of this invention, such a levelling strip 14 is made from a flexible material, with low elasticity to avoid the disadvantages which result from the undulation phenomena observed on the elastic strips used in the prior art.

The first free end 16 of the levelling strip is attached to the first free external edge 18 of the support frame 12, wherein it is attached by suitable traditional means that do not require any facilitated quick fitting or removal means, as was the case of the prior art where the strip sometimes had extension flaps.

The second free external edge 20 of the support frame 12 positioned on the other side of the cold laid coating strip to be applied, comprises a breast roller 22 with an axis that is substantially vertical on which the levelling strip 14 is tensioned by means of a winding device 24. Such a winding device is designed to apply a suitable tension to said levelling strip 14 while permitting the continuous adjustment of the working length of this levelling strip.

In the appended drawings, such a winding device 24 has been shown diagrammatically. In practice, the winding device advantageously comprises a motor which may be servo controlled to the adjustment of the working width of the applicator carriage. The design itself of the device for holding the levelling strip 14 according to the invention thus permits the winding device 24 to exert, along the entire length of the levelling strip, a tension that remains practically constant, independently of the working length to which said levelling strip is adjusted.

Figure 3:
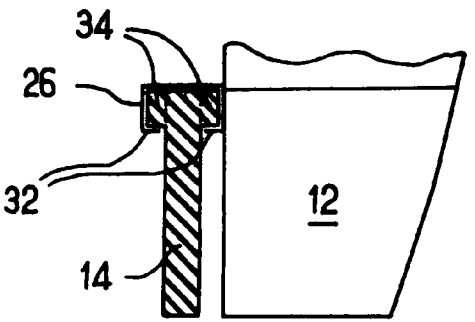
FIG. 3 shows a partial cross sectional view of the applicator carriage whose rear face is equipped with a levelling strip according to the invention.

The support frame 12 has along its entire length corresponding to the working width, a linear guide rail 26 with a "C" profile section, preferably angular as shown in FIG. 3, so that it may hold said levelling strip 14 with the possibility of moving by sliding its upper end 28 opposite the levelling 30 edge inside the rail 26 itself.

The linear guide rail 26 is therefore advantageously formed of at least two portions of rail 26*a* and 26*b*, mounted so that they may slide telescopically with respect to one another, so as to adapt to the precise width of the coating application zone.

As shown in FIG. 3, the free arms 32 of the "C" profile section extend towards one another over a short distance so as to surround and clamp the upper end 28 of the levelling strip.

To achieve this, the levelling strip 14 may advantageously comprise on either side of its upper edge, retaining protrusions 34 inside of such guide rail 26. The guide rail and the retaining protrusions of the levelling strip advantageously have profiled sections that are practically complementary so as to hold the levelling strip solidly in the working position, while allowing it to slide within said rail. In practice, it has been observed that it is advantageous to introduce inside the rail a lubricating agent to facilitate the sliding of the upper part of the levelling strip.

One embodiment in which the retaining protrusions 34 in the form of a continuous bead with an essentially rectangular, positioned on either side of the upper end of the levelling strip, thus giving it a straight "T" shaped section, has proved to provide perfectly satisfactory results in practice.

Figure 2:
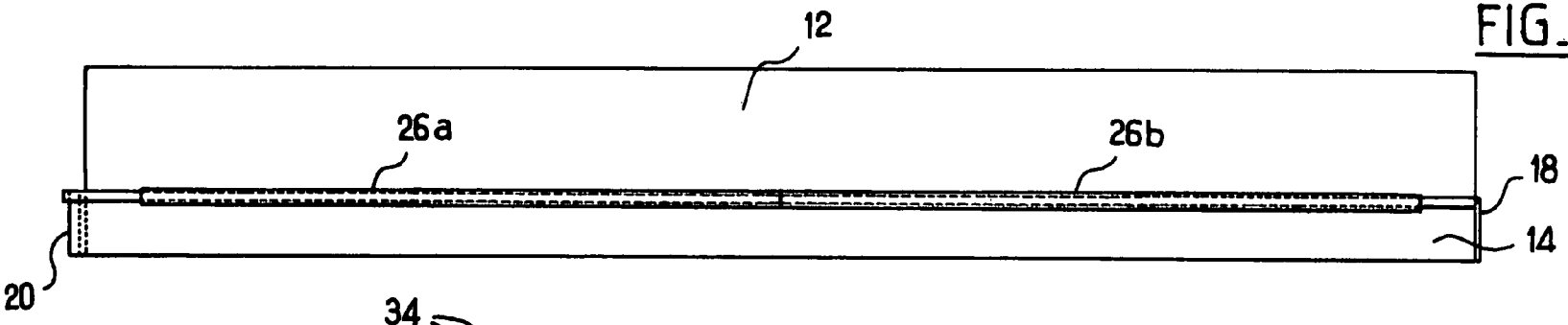
FIG. 2 shows a view of the rear face of the holding device according to the invention.
Figure 4:
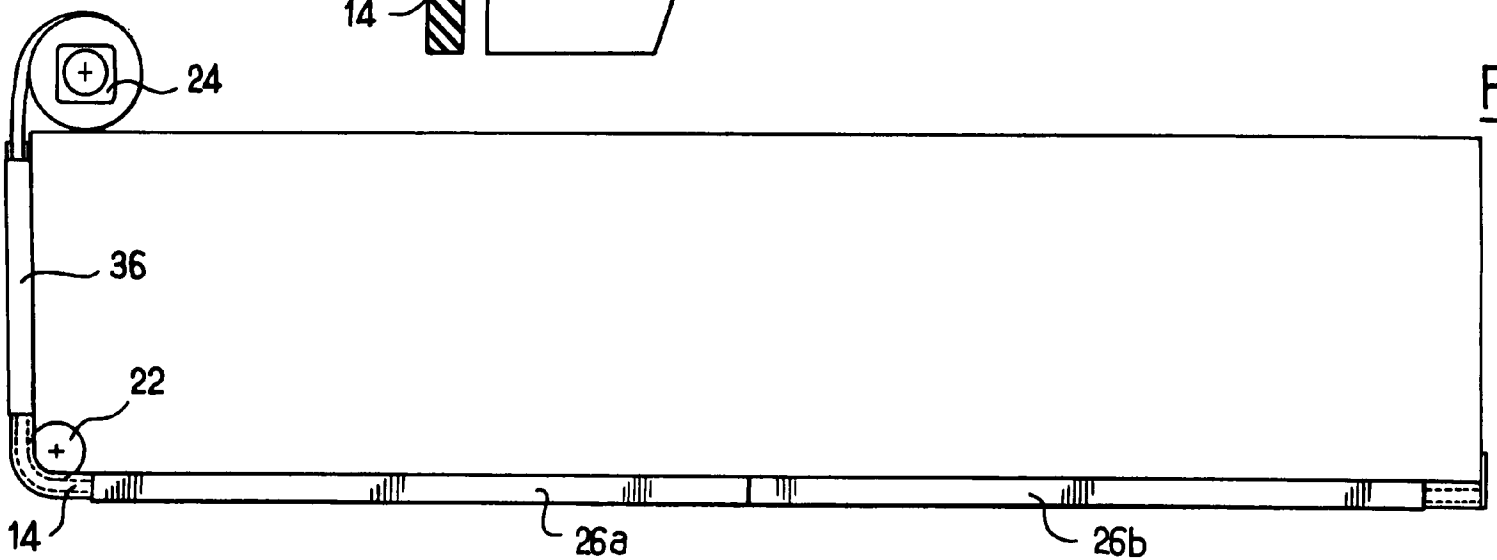
FIG. 4 shows a diagrammatical top view of such an applicator carriage equipped with a levelling strip.

As shown especially in FIGS. 2 and 4, the guide rail 26 of the levelling strip 14 extends beyond the return pulley 22 over a distance that is sufficient to permit at least partially the variations in length of the levelling strip when it is adjusted in length. Therefore, as shown in FIGS. 1 and 4, the linear guide rail 26 extends with an interruption, towards the front of the applicator carriage 10. The portion of prolongation rail 36 is also advantageously linear. Therefore, these two parts of linear guide rail 26 and prolongation rail 36, are interrupted precisely in the zone of the breast roller 22 in order to permit direct application of the levelling strip, partially or totally, on the lateral surface of said breast roller.

In practice, the portion of guide rail 36 which extends backwards will extend in a direction at least substantially parallel to the direction of movement of the carriage "D". In return, as shown in FIG. 1, this prolongation guide rail 36 may be slightly angled so that it rises towards the winding device 24 while remaining in a plane that is perpendicular to the part of the linear guide rail 26 holding the levelling strip in an effective position during the application of the cold laid coating. Advantageously, the levelling strip 14 will have the same retaining protrusions 34 on at least part of its length, which extend beyond the return pulley 22 towards the winding motor 24 when it is in the reduced width position.

In order to facilitate the creation and operation of the winding device, the levelling strip 14 will advantageously not have any retaining protrusions in its upper part along the entire winding length on the motor winding shaft, regardless of the length of the levelling strip.

A device is thus obtained for holding a levelling strip on a carriage for applying cold laid coatings which, in practice, has allowed considerable improvement in the application of the rubber levelling strips, has led to considerable time savings in the automatic adaptation phases of the width of application of the coating and which, has furthermore led to clear enhancement of the quality of levelling of the coatings applied.

The invention claimed is:

1. Device for holding a levelling strip (14) on a carriage for applying cold laid coatings, wherein said strip extends in a direction that is generally perpendicular to the direction of movement of the carriage, wherein said carriage comprises on the rear side opposite the direction of movement of a support frame (12) which has a length that is adjustable to adapt to the width of the application zone of the coating and which holds a levelling strip (14), made from a flexible, slightly elastic material, of which one first free end (16) is attached to a first free external edge (18) of the support frame, and wherein the second free external edge (20), that is opposite the first, of the support frame comprises a vertical axis breast roller (22) on which the levelling strip (14) is tensioned by means of a winding device (24) that applies to said strip a suitable tension while permitting the continuous adjustment of the working length of said strip.

2. Device according to claim 1, wherein the support frame (12) comprises, along its entire length corresponding to the width of the zone of application of the coating, a linear guide rail (26) with a "C" profile section, preferably angular to hold the levelling strip (14) with the possibility of moving by sliding its upper end opposite the levelling edge, wherein the linear guide rail is formed by at least two portions of rails (26*a*, 26*b*) mounted so that they can slide telescopically so as to adapt to the width of the zone of application of the coating.

3. Device according to claim 2, wherein the free arms (32) of the "C" section extend towards one another over a short distance to surround the upper end of the levelling strip (14).

4. Device according to claim 3, wherein the end (28) of the levelling strip (14) comprises on either side of its upper edge retaining protrusions (34) inside the guide rail (26).

5. Device according to claim 4, wherein the guide rail (14) and the retaining protrusions (34) have complementary profiles so as to hold the levelling strip in the work position while authorising its sliding movement inside said rail, preferably with a lubricating agent.

6. Device according to claim 4, wherein the retaining protrusions (34) are in the form of a continuous bead with a rectangular section, positioned on either side of the strip (14) which give it a straight "T" shaped section.

7. Device according to claim 1, wherein the guide rail of the levelling strip (14) extends in return beyond the return pulley (22) over a distance that is adequate to absorb at least partially the variations in length of the levelling strip (14) when its length is adjusted.

8. Device according to claim 7, wherein the guide rail (26) of the strip (14) extends in return in a direction that is substantially parallel to the direction of movement of the carriage.

9. Device according to claim 3, wherein the levelling strip has retaining protrusions (34) over a certain length which extend beyond the return pulley (22) towards the winding device (24).

10. Device according to claim 9, wherein the levelling strip has no retaining protrusions along its entire winding length on the winding shaft of the motor.

11. Device according to claim 1, wherein the winding device (24) comprises a motor that is servo controlled to the adjustment of the working width of the applicator carriage.

12. Device according to claim 1, wherein the winding device exerts along the entire length of the strip a tension that is practically constant independently of the working length of the latter.

* * * * *